US005960483A

United States Patent [19]

Delzer et al.

[11] Patent Number: 5,960,483

[45] Date of Patent: Oct. 5, 1999

[54] LAVATORY HAVING A SWIVELLING BOWL

[75] Inventors: Siegfried Delzer, Lörrach, Germany; Hans Ulrich Kunz, Arlesheim, Switzerland; Holger Küttenbaum, Lörrach, Germany

[73] Assignee: Keramik Laufen AG, Laufen, Switzerland

[21] Appl. No.: 08/894,046

[22] PCT Filed: Nov. 12, 1996

[86] PCT No.: PCT/CH96/00398

§ 371 Date: Dec. 15, 1997

§ 102(e) Date: Dec. 15, 1997

[87] PCT Pub. No.: WO97/21002

PCT Pub. Date: Jun. 12, 1997

[30] Foreign Application Priority Data

Dec. 7, 1995 [CH] Switzerland ..... 3454/95

[51] Int. Cl.[6] ..... E03D 11/12

[52] U.S. Cl. ..... 4/420; 4/312; 4/233

[58] Field of Search ..... 4/420, 441, 442, 4/233, 307, 312, 438, 440

[56] References Cited

U.S. PATENT DOCUMENTS

| | | | |
|---|---|---|---|
| 1,097,569 | 5/1914 | Sweeney | 4/312 |
| 2,879,519 | 3/1959 | Mueller | 4/312 |
| 3,829,906 | 8/1974 | McPhee | 4/312 |
| 3,919,726 | 11/1975 | Godwin et al. | 4/312 |
| 4,183,105 | 1/1980 | Womack | 4/233 |
| 4,944,047 | 7/1990 | Gagliano | 4/312 |
| 5,454,123 | 10/1995 | Barabino | 4/233 |
| 5,502,845 | 4/1996 | Hayashi et al. | 4/420 |

FOREIGN PATENT DOCUMENTS

| | | | |
|---|---|---|---|
| 2-304131 | 12/1990 | Japan | 4/307 |
| 91/16510 | 10/1991 | WIPO | 4/312 |

*Primary Examiner*—Charles R. Eloshway
*Attorney, Agent, or Firm*—Anderson, Kill & Olick, P.C.

[57] ABSTRACT

The lavatory has a housing in which a dish-like bowl having a seat is pivotably inserted. The bowl can be swivelled from a position of use into a flushing position. Furthermore, a cleaning apparatus which serves for cleaning the seat and the bowl with pressurized water in the flushing position is arranged in the housing. This cleaning apparatus has for this purpose a cover which overlaps the spray nozzles serving for cleaning the bowl and seat. In the flushing position, the cover and the bowl together bound a cleaning space which is sealed fluid-tight from the interior of the housing. During the cleaning process, even contaminants adhering stubbornly to seat surface or inner wall of the bowl are removed by the pressurized water and washed in the direction of the feces drain. After the cleaning with pressurized water, the bowl and the seat are dried with cold or hot air, for which purpose the cleaning apparatus is additionally provided with a fan.

5 Claims, 6 Drawing Sheets

36
35
28
21b
26
25
33
23b
27
5
27
24
4
6
22
23a
23
20
8
21
32
7a
21a
14
7c
13
11
7b
12
10a
7
3
2
15
9
10
1

36
35
23b
28
27
23
4
22
21
20
23a
8
44
43
42
11
12
7
7b
13
3
7b
2
40
M
41
15
1

LAVATORY HAVING A SWIVELLING BOWL

FIELD OF THE INVENTION

The invention relates to a lavatory having a swivelling bowl, namely a lavatory according to the preamble of claim 1.

Lavatories of this type are erected in particular in highly frequented places, such as, for example, in restaurants, railway stations, hotels, business premises and the like, and generally have a housing consisting of plastic and a bowl preferably formed from ceramic material.

A principal problem in the maintenance of such lavatories is the satisfactory cleaning of the bowl and seat. Such lavatories are visited by the public only when they are hygienically cleaned in every respect.

DESCRIPTION OF THE PRIOR ART

International patent application WO 91/16510 discloses a lavatory having a dish-shaped bowl which is inserted in a housing forming a flushing tank and can be swivelled. The bowl is suspended in a frame opening of the housing and can be swivelled about 90° from a position of use into a flushing position. The flushing tank formed by the housing has, in its wall opposite the frame opening, a plurality of spray nozzles which serve for cleaning the seat and bowl and are connected to a flushing water reservoir. In addition, the lavatory has an immovable trap which is arranged at the lower end of the flushing tank and is connected to a drainpipe.

A further lavatory of a similar type is disclosed in German Patent No. 4,132,265. This prior publication discloses a lavatory means which has a receiving opening facing the room and having a lavatory bowl rotatably suspended therein, and a drain arranged in the region of the floor. The bowl is provided, at the rear, with a spout which faces the drain in the position assumed when swivelled up. Furthermore, at least one closable spray nozzle which directs the water jet toward the swivelled-in bowl when the latter is swivelled up is arranged in the interior of the means.

During cleaning of the above-mentioned lavatory, the seat and the bowl are sprayed with water by means of the nozzles firmly anchored in the wall of the tank or by means of the nozzles fixed in the housing. This type of water transport has the disadvantage that, with the fixed spray nozzles, only sect ions of the seat surface or bowl wall are directly sprayed, namely those which are directly opposite the nozzle openings. The other surface or wall sections are sprayed—if at all—only by the water stream flowing toward the drain. It is obvious that thorough and complete cleaning, in particular elimination of dirt adhering to the wall of the bowl, is not possible by this method of water transport.

Moreover, with this method of water transport, it is likely that coarse particles and paper can be flushed out of the bowl and through the trap only with the use of a relatively large amount of water, resulting in particular in ecological disadvantages.

SUMMARY OF THE INVENTION

It is the object of the p resent invention to propose a lavatory which does not have the disadvantages of the above-mentioned lavatory, i.e. permits inter alia effective and complete cleaning of bowl and seat.

This object is achieved, according to the invention, by a lavatory having the features of patent claim 1.

Advantageous embodiments of the lavatory form the subject of the dependent claims.

In the lavatory according to the invention, cleaning is carried out exclusively with pressurized water. With the aid of pressurized water, impurities adhering to the seat and bowl can be removed without problems, and coarse particles and lavatory paper can be removed from the bowl.

BRIEF DESCRIPTION OF THE DRAWINGS

The invention is illustrated in more detail below with reference to the drawings. In the drawings.

DESCRIPTION OF THE PREFERRED EMBODIMENT

Figure 1:
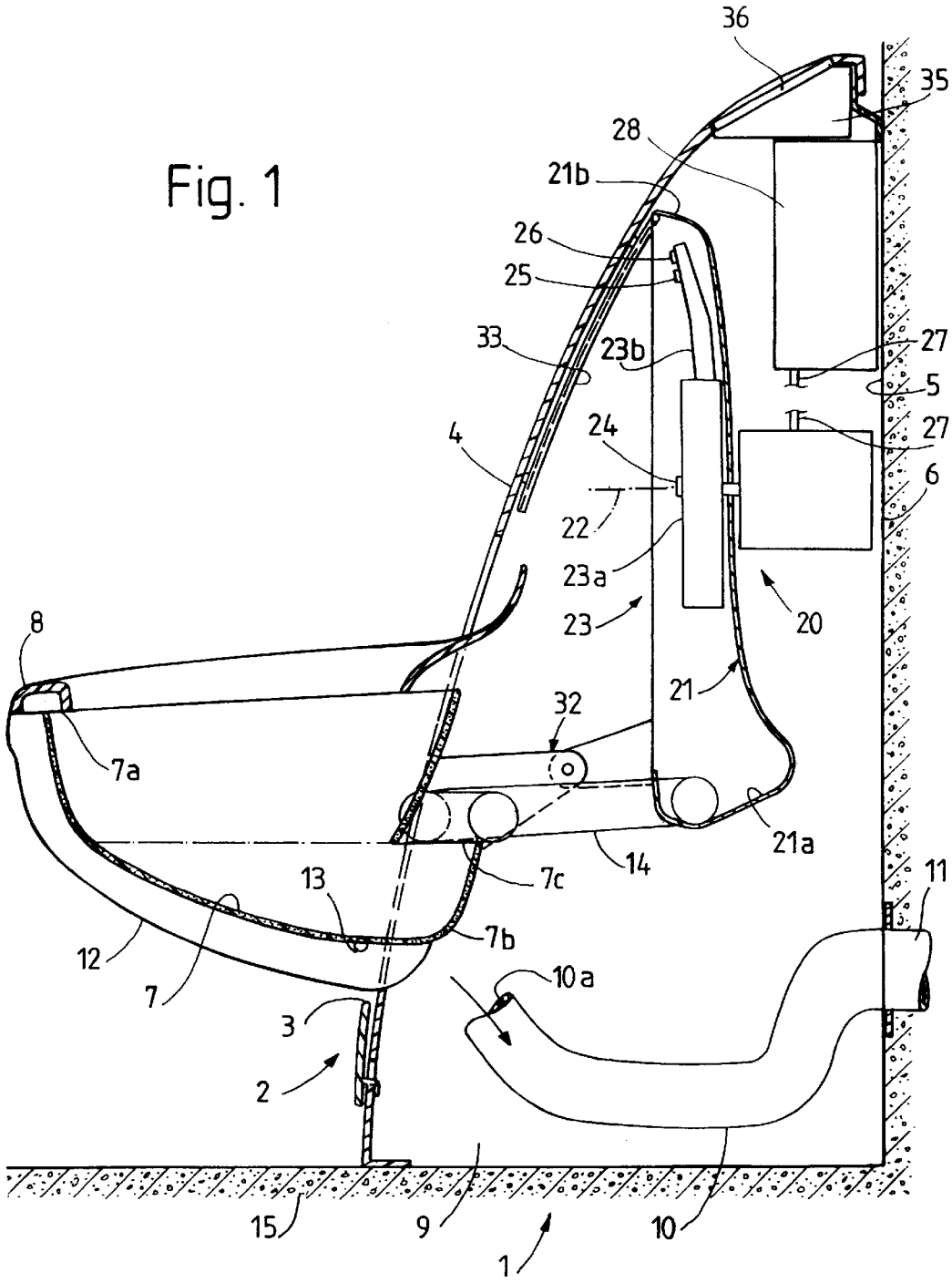
FIG. 1 shows a schematic representation of a lavatory with the bowl swivelled out into the position of use.

The lavatory shown in FIGS. 1 to 5 and denoted as a whole by 1 has a housing 2 preferably formed from plastic. Said housing possesses a front wall 4 having a frame opening 3, and a rear wall 5 pressed against a mounting wall 6. A ceramic bowl 7 with a seat 8 fastened to the bowl edge 7*a* is inserted in the frame opening 3 of the front wall 4 and can be swivelled.

The interior 9 of the housing 2 is provided, in the region of the floor with a feces drain 10 which is designed in the usual manner in the form of a trap for excluding odors. The drain 10 enters into an outlet connection 11 which can be connected, by means of a seal, to a pipeline arranged in the mounting wall 6 and not shown in more detail here.

The bowl 7 is inserted into a bowl housing 12 and fastened thereto. In the lower region of the frame opening 3, the bowl 7 is rotatably fastened to the housing 2 by means of two hinges 13 which are opposite one another and arranged on the bowl housing 12. At its end 7*b* projecting into the interior 9, the bowl 7 is finally provided with a feces outlet 7*c* into which a movable and/or extendable outflow hose 14 additionally enters.

Figure 2:
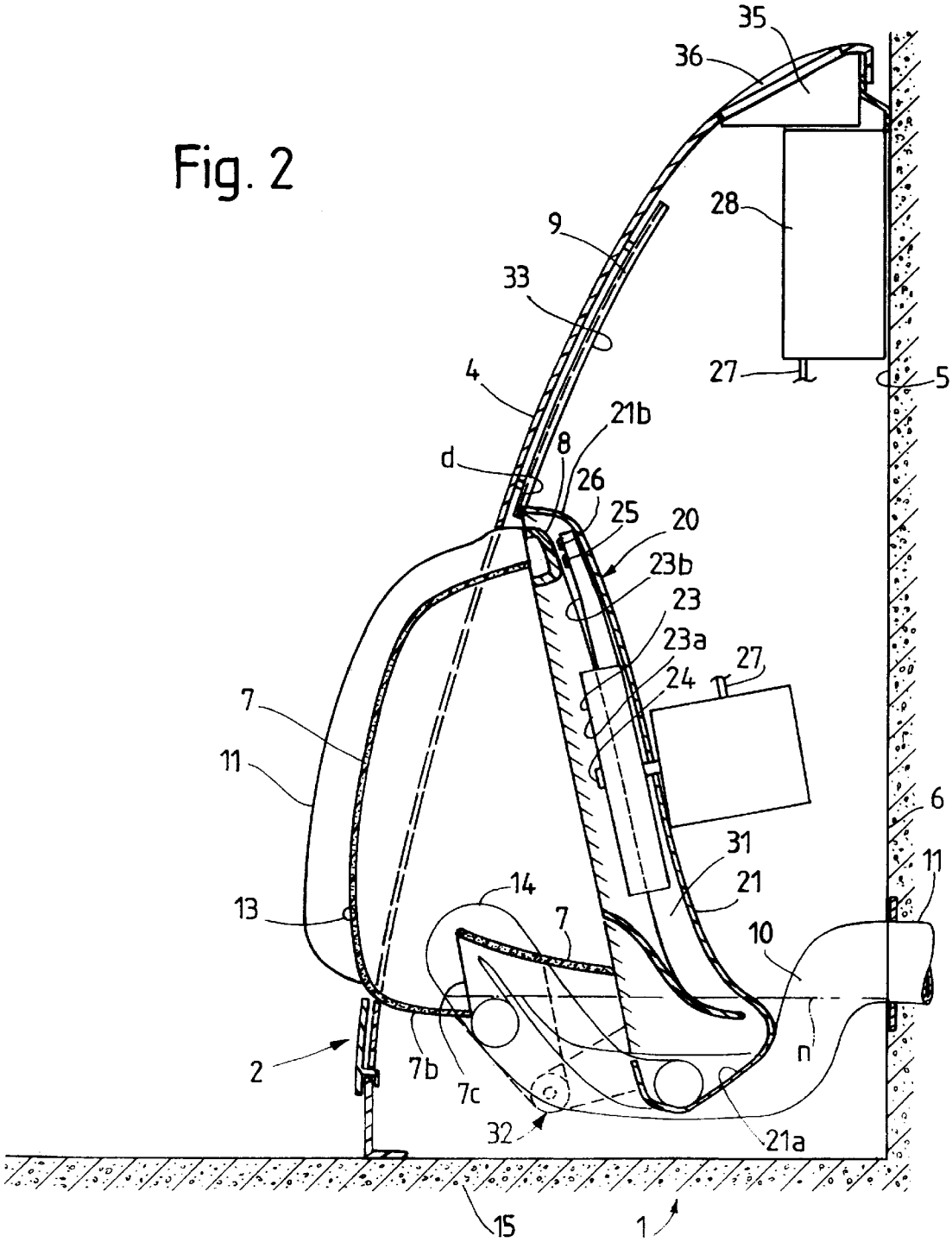
FIG. 2 shows a schematic representation of the lavatory shown in FIG. 1, with the bowl swivelled into the flushing position.
Figure 3:
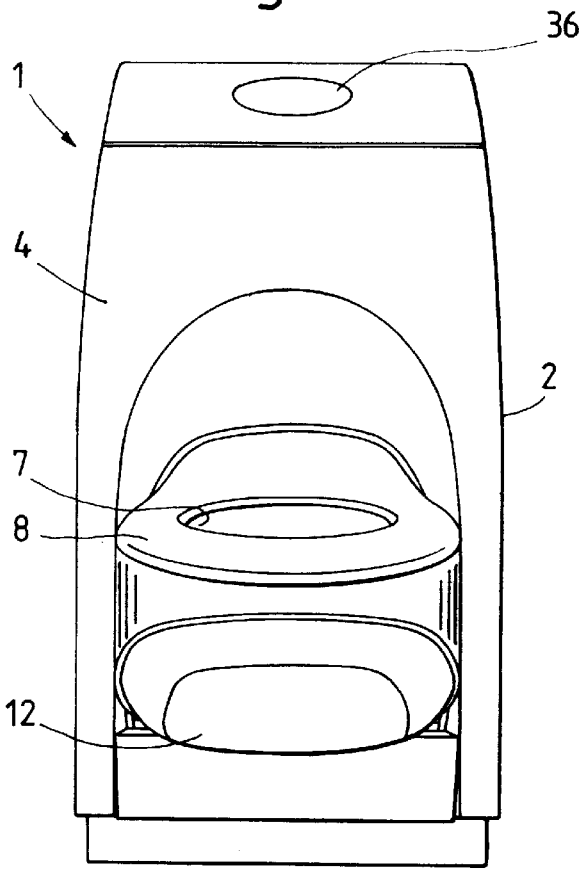
FIG. 3 shows a view of the lavatory shown in FIG. 1.

A separate swivelling apparatus serves for swivelling the bowl 7. Said apparatus may be formed in various ways and may swivel the bowl 7 or the bowl housing 12 about one axis of rotation or, if required, two axes of rotation into the interior 9—as shown in FIGS. 1, 2 and 3. Embodiments of swivelling apparatuses which may be used for the purposes of the invention are described below with reference to FIGS. 5 and 7.

Figure 4:
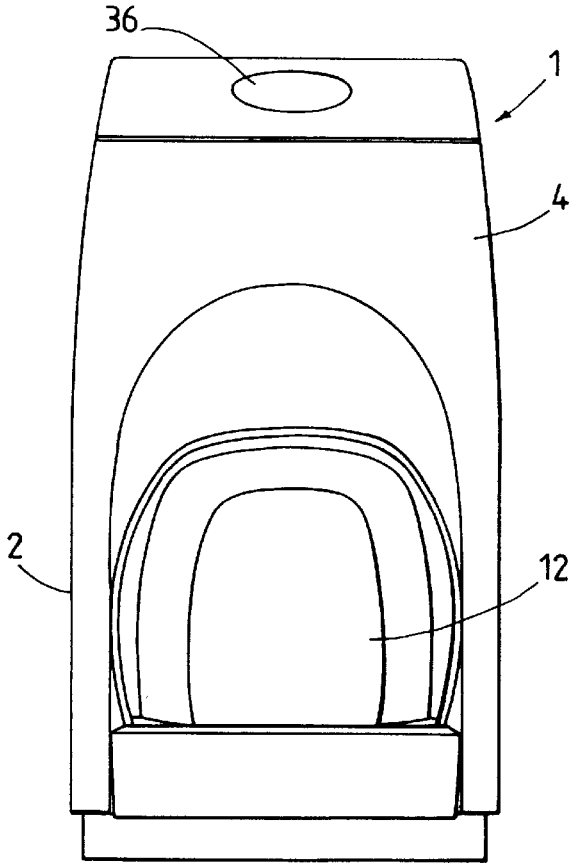
FIG. 4 shows a view of the lavatory shown in FIG. 2.

Thus, the bowl 7 and the seat 8 are swivelled by means of a swivelling apparatus from the position of use shown in FIGS. 1 and 3 into the flushing position shown in FIGS. 2 and 4, and back.

In the position of use, the bowl 7 projects out of the frame opening 3 at the usual seat height above the floor 15. In the flushing position, the bowl 7 is lowered at least partly into the housing 2, the outlet 7*c* being swivelled into the opening 10*a* of the drain 10 so that the content of the bowl 7 is emptied directly into the drain 10 during the flushing or cleaning process.

Furthermore, a cleaning apparatus 20 which serves in particular for cleaning and drying the seat 8 and the bowl 7 in the flushing position is arranged in the housing 2 of the lavatory 1. For this purpose, the cleaning apparatus 20 has a cover 21 which surrounds a cleaning system 23 rotatable about an axis 22. Said cleaning apparatus has essentially a central member 23*a* and a rotating arm 23*b* emanating from this. The central member 23*a* and rotating arm 23*b* are provided with spray nozzle 24 and spray nozzles 25 and 26 directed into the bowl 7 and onto the seat 8, respectively, in the flushing position. These spray nozzles 24, 25, 26 are connected by a flexible flushing water supply pipe 27 to a water reservoir 28, which in turn is equipped with a magnetically controllable valve.

The central member 23*a* of the cleaning apparatus 20 has pumping means, for example a side-channel pump, for subjecting the flushing water to pressure and guiding it through the said nozzles 24, 25 and 26 into the bowl 7 to be cleaned or onto the seat 8 to be cleaned. Furthermore, fan means which optionally cooperate with the said pumping means and serve for generating a cold or warm air stream are installed in the central member 23*a*. The fan means comprise, inter alia, air channels directed into the bowl 7 or onto the seat 8 and can alternatively warm or heat the air stream so that the hot air thus produced heats the flushing water during the cleaning process and blows at least the seat 8 completely dry after cleaning with flushing water is complete. The drying of bowl 7 and seat 8 can of course also be carried out with cold air.

The cleaning apparatus 20 is furthermore pivotably connected to the bowl housing 12 in such a way that it assumes an inclined rest position in the position of use and, for the cleaning process, can be moved together with its cover 21 from the rest position onto the bowl 7 swivelled into the flushing position, this being done in such a way that the cleaning cover 21 together with the bowl 7 bounds a cleaning space 31 which is closed fluid-tight from the interior 9, if required the cover 21 being provided for this purpose with sealing means mounted on the edges.

In order to swivel the cleaning apparatus 20, the cover 21 with its collecting tank 21*a* can be hinged to the bowl housing 12 by means of a hinge 32 and can be displaceably guided, with its end 21*b* shown at the top in FIG. 1, on a rail 33, so that the swivelling in of the bowl 7 and the swivelling of the cleaning apparatus 20 can take place simultaneously and by only one drive means.

Finally, the lavatory 1 also has an electronic control means 35 which is represented by a block and by means of which the swivelling in and out of bowl 7 and seat 8 and also the sequence of the cleaning process described below can be completely or partially automatically controlled. This control means 35 includes a control circuit having electrical and/or electronic components for measurement, control and regulation. The control circuit is connected, by means of electric cables not shown in the Figures, to the swivelling apparatus and the means 20 and 31 and all other drivable and controllable parts of the lavatory 1. The individual electrically or electronically controllable parts or elements are expediently also controllable and locked relative to one another in a time-dependent manner. The control means 35 furthermore has at least one operating element, for example a sensor switch 36, by means of which the flushing process described below can be manually triggered.

Following the detailed description of an embodiment of the invention, it is now intended to describe in more detail the cleaning process which serves for cleaning bowl 7 and seat 8.

The lavatory 1 shown in FIGS. 1 to 4 is as a rule encountered by its user in the position of use. After the lavatory 1 has been used by the user, bowl 7 and seat 8 are swivelled into the flushing position automatically or by actuation of the sensor switch 36, whereupon at least a part of the bowl content is emptied into the drain 10 and the actual cleaning process is triggered. For cleaning, the cleaning apparatus 20 with its cover 21 is positioned on the bowl 7 or seat 8, as shown in FIG. 2. The cleaning space 31 is sealed in such a way that the flushing water to be passed into it flows away along the sealing edge d and enters the drain 10 or is optionally received by the collecting tank 21*a* of the cover 21.

The seat 8 and the inner wall of the bowl 7 are then sprayed and cleaned during a first cleaning phase with pressurized water passed through the spray nozzles 24, 25 and 26, this being effected at a pressure of, for example, 1000 to 3000 kPa and a nozzle spacing of about 3 to 10 cm. During this cleaning phase, the cleaning system 23 is turned about the axis 22 and the remaining content of the bowl 7 is flushed into the drain 10.

During the first cleaning phase covering a period of, for example, 5 to 30 seconds, even stubborn contaminants and dirt particles adhering to the seat surface or inner wall of the bowl are detached and washed into the drain 10, possibly together with other coarse particles, such as, for example, lavatory paper. At the same time or slightly later, hot air can be blown by the fan means into the cleaning space 31 bounded by the cover 21 and the bowl 7, for example into the joint jet of the nozzles 24, 25 and 26, so that stubborn adhering dirt can be removed from the seat 8 or from the inner wall of the bowl 7 by means of the pressurized water warmed or heated in this manner. Here, the fan means may also be controlled in such a way that the seat surface is heated briefly, for example for 2 to 30 seconds, to a temperature of more than 100° C., preferably 150–200° C., with the result that virtually all microorganisms present on the seat surface are destroyed.

After the first cleaning phase, the water supply is stopped and the seat 8 and the bowl 7 are blown dry by the fan means in a second cleaning phase, this being effected with cold or, if required, hot air so that a subsequent user is provided with a dry sanitary facility.

For the cleaning process described above, the cleaning mechanism according to the invention requires only about 0.5 to 3 liters of water, i.e. a relatively small amount of water. The time required for cleaning and drying bowl 7 and seat 8 is, for example, 0.5 to 2 minutes.

As is evident from FIG. 2, the collecting tank 21*a* of the cover 21 comes to rest below the water level n during the cleaning process. A water removal mechanism which allows the flushing water to flow from the collecting tank 21a into the drain 10 when the bowl 7 is swivelled out is therefore required. This is permitted, according to the invention, by the drain hose 14, one end of which rests in the collecting tank 21*a* and the other end of which enters the bowl 7; when the bowl 7 is swivelled out to the position of use, the flushing water is first transported upward, from where it can then flow through the drain hose 14 into the drain 10.

When the bowl 7 is swivelled into the housing 2, the front part of the bowl edge 7*a* is moved upward and the rear part of the bowl edge 7*a* downward so that the bowl 7 assumes an inclined position in the flushing position. As already mentioned, a swivelling means, for example a means of the type shown in FIG. 5, serves for swivelling the bowl 7.

Figure 5:
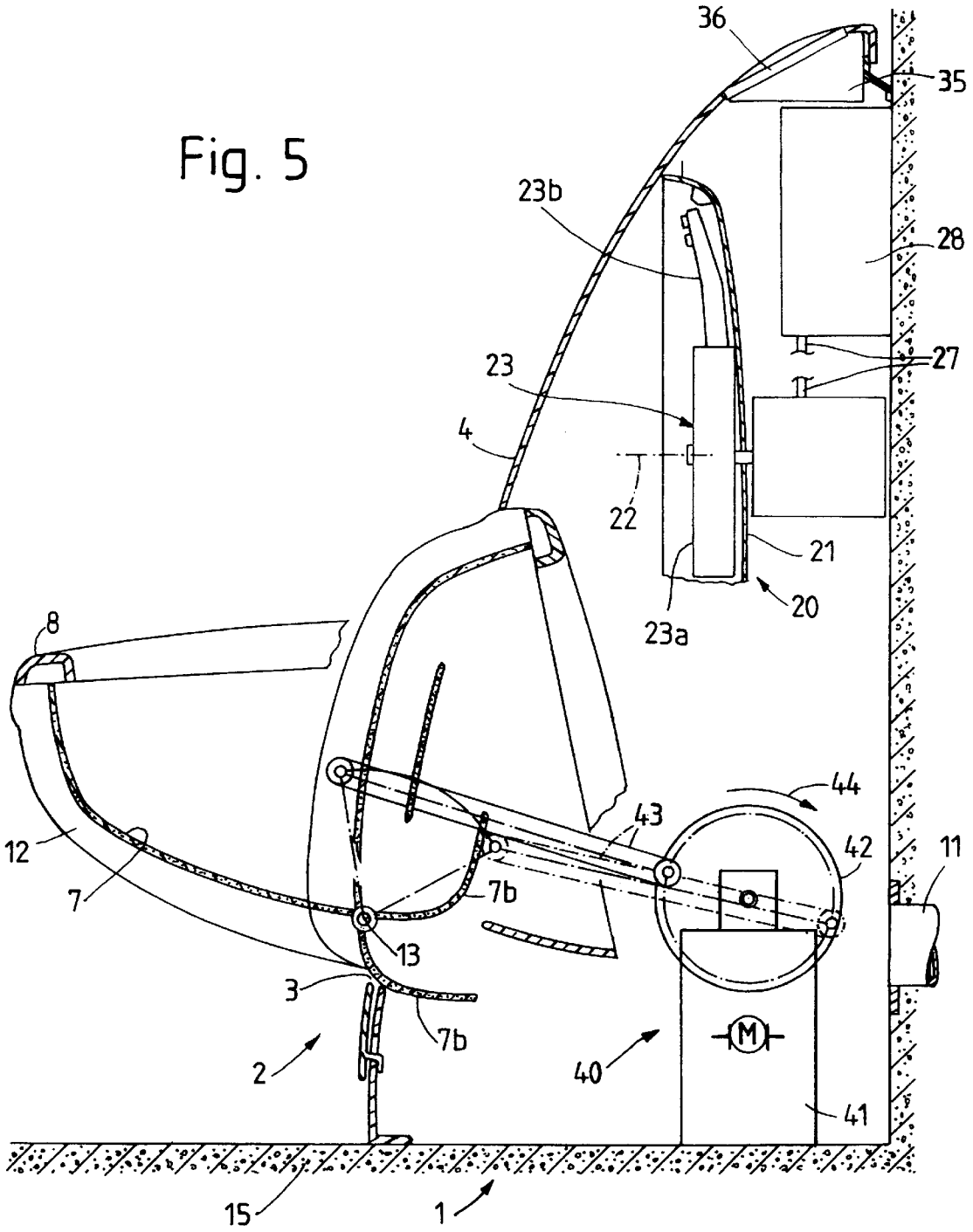
FIG. 5 shows a schematic representation of a swivelling mechanism and FIGS. 6 and 7 each show a schematic representation of another lavatory with the bowl swivelled out into the position of use.

The swivelling apparatus 40 shown only schematically in FIG. 5 has an electric motor 41 with a drive wheel 42 and an associated lever arm 43. The latter is connected in an articulated manner at its two ends with the drive wheel 42 and the hinge 13 of the bowl housing 12. The design of the articulated connection has been chosen only so that the bowl 7 can be swivelled from the position of use into the flushing position and back by rotating the drive wheel in the direction 44 indicated by the arrow. By means of this swivel mechanism, it is possible in particular to dispense with a change in the direction of rotation of the drive shaft each time before swivelling in or swivelling out, which finally results in a gentle and virtually silent swivelling movement.

Figure 6:
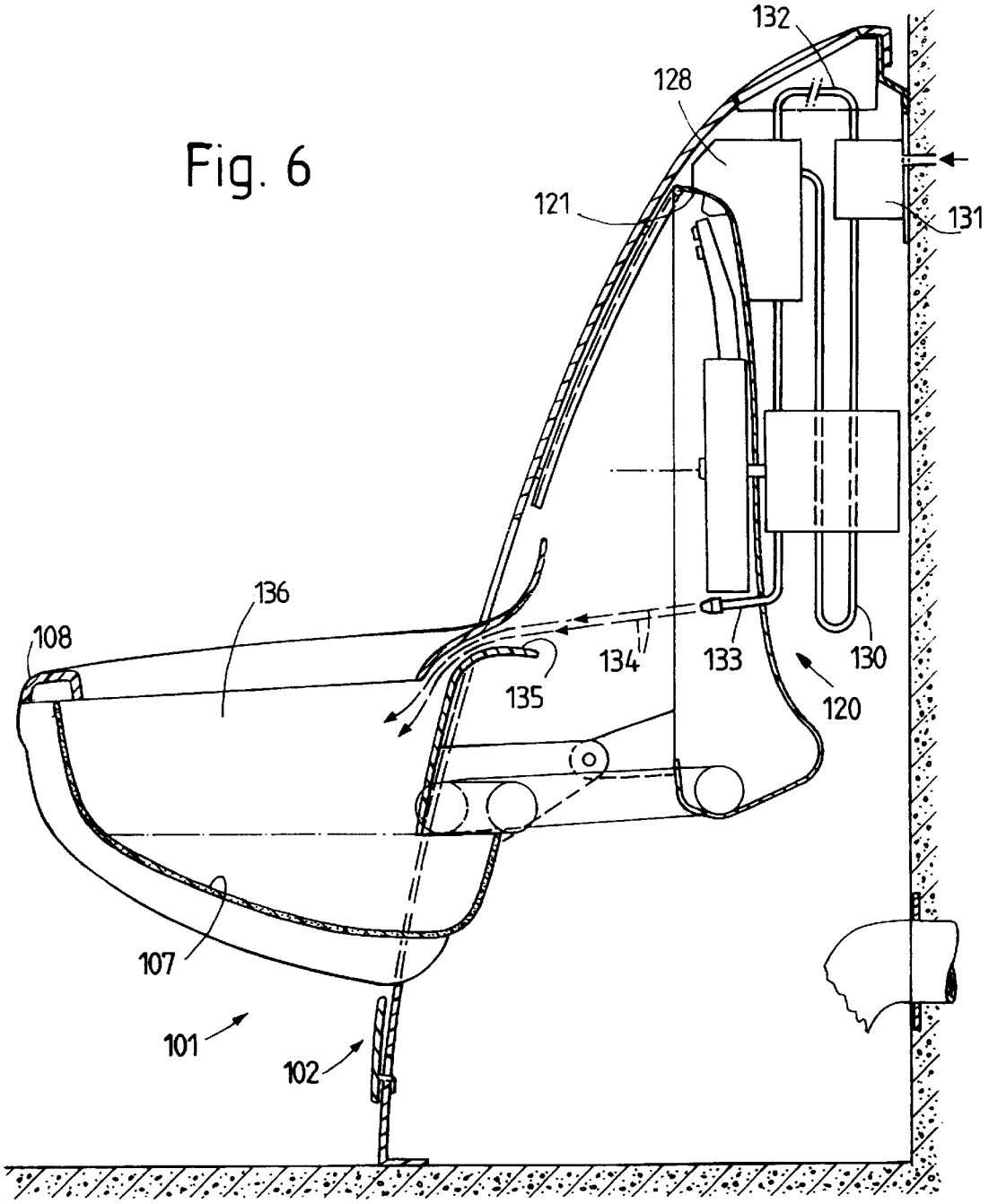

The lavatory shown in FIG. 6 only in the position of use and denoted as a whole by 101 has essentially the same design as the lavatory 1 described with reference to FIGS. 1 to 4, ie. has a housing 102 in which a bowl 107 with a seat 108 arranged on the bowl 107 is pivotably inserted.

However, the lavatory 101 differs from the lavatory 1 in that the flushing water reservoir 128 is arranged not on the housing 102 but on the cover 121 of the cleaning apparatus 120 and is connected to the water inlet vessel 131 via a movable flushing water line 130. The flushing water reservoir 128 and water inlet vessel 131 are furthermore connected to one another by means of a pressure relief hose 132.

As in the case of the lavatory 1 described with reference to FIGS. 1 to 4, the lavatory 101, too, has a cleaning apparatus 120 with pump and fan means, so that the cleaning process described with reference to the lavatory 1 can be carried out in an analogous manner also with the lavatory 101.

However, the cleaning apparatus 120 which serves for cleaning bowl 107 and seat 108 additionally has a spray nozzle 133 which is connected to the reservoir 128 and is dimensioned and oriented in such a way that flushing water under pressure or flushing water can also be sprayed into the bowl 107 in the position of use—to effect intermediate flushing. In the variant shown, the pressurized water passes as free jet 134 into a funnel-like opening 135 of the bowl 107 and from there into the interior 136 itself.

Figure 7:
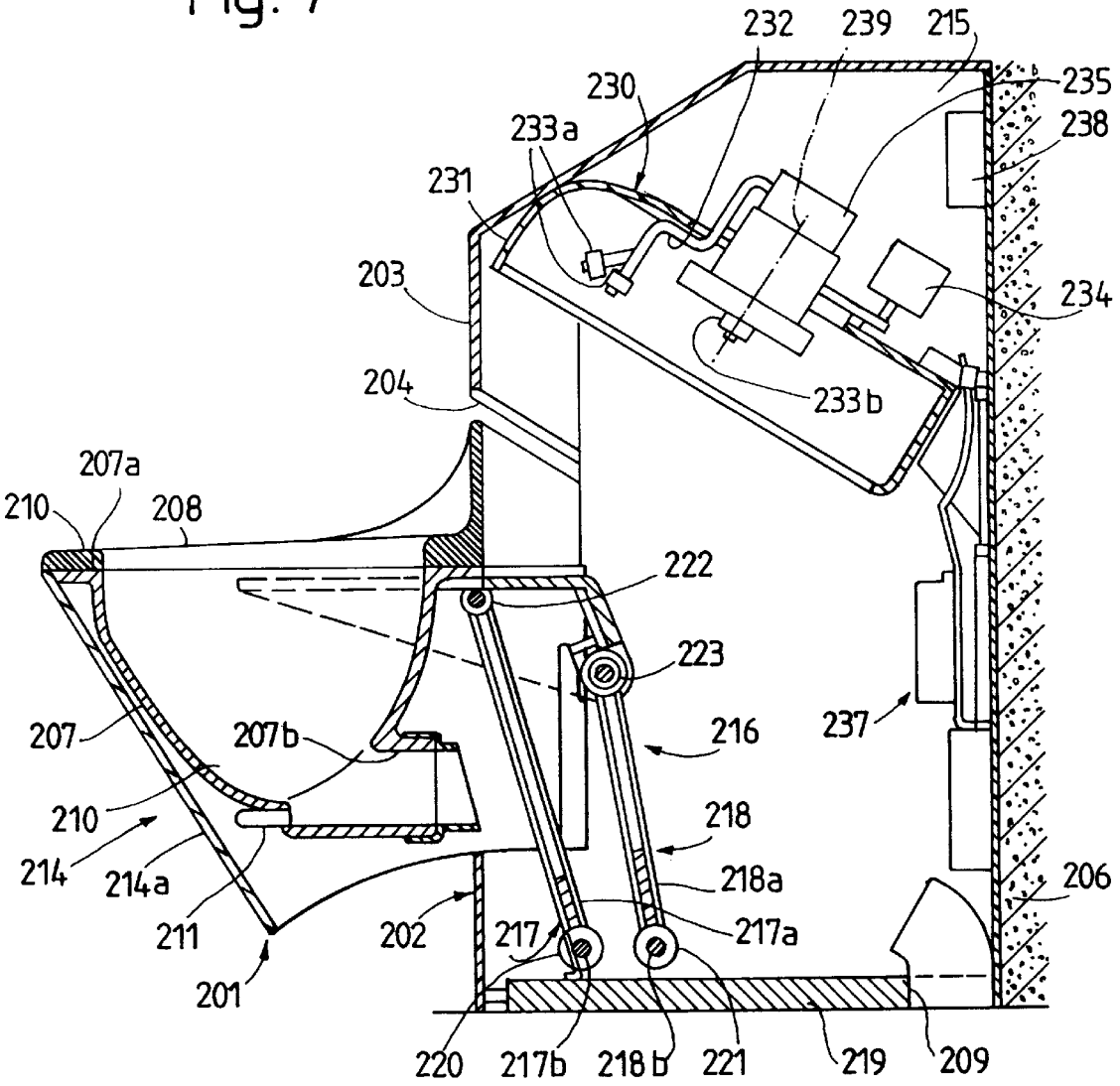

FIG. 7 shows a further variant of a lavatory according to the invention. The lavatory shown in this Figure and denoted as a whole by 201 has a plastics housing 202 whose front wall 203 is provided with a frame opening 204 and is adjacent to a mounting wall 206. A bowl 207 with a seat 208 fastened to the bowl edge 207*a* is pivotably inserted in the frame opening 204. The bowl 207 furthermore has a feces outlet 207*b* which is connected to a feces drain 209 by means of a movable and/or extendable trap not shown in the drawing. An alternatively openable or closable pressurized water supply pipe whose opening is formed by a spray nozzle 211 and is opposite the feces outlet 207*b* of the bowl 207 furthermore opens into the interior 210 of the bowl 207. The bowl 207 is finally inserted in a bowl housing 214 and is fastened thereto.

Furthermore, a swivelling apparatus 216 which serves for swivelling the bowl housing 214 is arranged. in the interior 215 of the housing 202. Said swivelling apparatus has two U-shaped supports 217 and 218 supporting the bowl 207. These supports each have two limbs 217*a* and 218, respectively, arranged parallel to one another and each have a central piece 217*b* and 218*b*, respectively, which connects the limbs 217*a* and the limbs 218*a,* respectively, to one another and is oriented horizontally and parallel to the front wall 203. The central piece of each support is fastened by means of pivot bearings 220 and 221, respectively, to a fixed base 219 in such a way that the supports 217 and 218 are rotatable about the longitudinal axis of their central piece. Moreover, the bowl housing 214 carrying the bowl 207 is suspended from, in each case, two lateral pivot bearings 222 and 223 at the ends of the limbs 217*a* and 218*a*.

The bowl 207 and the seat 208 can be swivelled from the position of use shown in FIG. 7 into the flushing position not shown, and back again, by the swivelling apparatus 216. In the flushing position, the bowl 207 is completely in the housing 202, the front wall 214*a* of the bowl housing 214 closing off the frame opening 204 of the housing 202 virtually without gaps.

When the bowl 207 is swivelled into the housing 202, the front part of the bowl edge 207*a* is moved upward and the rear part of the bowl edge 207*a* downward. Here, an electric motor not shown in the drawing, for example an electric window motor known from the automotive industry, is used here for swivelling the bowl 207.

Furthermore, a cleaning apparatus 230 is arranged in the housing 202. This has a cover 231 which is open at the bottom and below which is arranged a spray arm 232 which is rotatable about an axis and is provided in the flushing position with spray nozzles 233*a* directed onto the seat 208 and into the bowl 207. A motor 234 having drive means serves for rotating the spray arm. A further spray nozzle 233*b* is arranged centrally below the cover 231. The spray nozzles 233*a* and 233*b* are connected by means of a pipe for flushing water supply which is not shown in the drawing and which has a water tank and a pressurized water source which serves for generating pressurized water. Said source may have, for example, at least one storage tank and a centrifugal pump which serves for generating pressurized water.

Moreover, the cleaning apparatus 230 also has a fan 235 which is separated from the other parts of the means 230 and is used, during the cleaning process, for alternatively warming or heating the pressurized water emerging from the spray nozzles 233 and for drying the bowl 207 and the seat 208 with cold or hot air after the cleaning process.

The cleaning apparatus 230 is furthermore fastened to a vertically displaceable support means 237 in such a way that it can be positioned for the cleaning process with its cover 231 on the bowl 207 or seat 208 swivelled into the flushing position.

Finally, the lavatory 201 also has a control means 238 of the type described above.

If the lavatory 202 is presented to a user in the flushing position, the bowl 207 can be swivelled out by actuating a pushbutton switch or automatically by sensor means.

If the lavatory is not used for a relatively long time, the fan 235 can be periodically put into operation by the control means 238, for example with a time interval of 30 minutes, or briefly by the user shortly before use of the lavatory, in order to warm up the surface of the seat 8 with warm air and thus to provide the user with a preheated seat 8.

After the lavatory 201 has been used by a person, bowl 207 and seat 208 are cleaned and dried as already described above, for which purpose the bowl 207 assumes an inclined position in the flushing position, the cleaning apparatus 230 is then positioned with its cover 231 on the bowl 207 or seat 208 and the spray arm 232 carrying the spray nozzles 233 is then rotated about the axis 239 perpendicular to the seat area of the bowl 207 which has been swivelled in.

Finally, it should also be pointed out here that the three lavatories described with reference to FIGS. 1 to 7 represent only a selection from a plurality of possible embodiments of the invention and can be modified in various respects.

Thus, for example, it is possible to mount some of the spray nozzles, in particular spray nozzles directed toward the inner wall of the bowl, in an angularly adjustable manner during the cleaning process, so that the jet cones of the spray nozzles are guided in a wavy fashion over the surfaces to be cleaned and stubbornly adhering dirt is thus also washed away even more effectively.

Furthermore, optical sensors for detecting the degree of soiling of seat and bowl may be arranged in the cleaning cover, which sensors are connected to the control means via electric cables so that the cleaning process, in particular the nozzle guidance, can be optimally tailored to the degree of soiling, depending on the signals measured by the sensors.

Finally, the lavatory may also have containers for chemical cleaning agents which, depending on the requirements, can be sprayed alone or together with the flushing water, in order thus to obtain a completely germ-free bowl wall and seat surface.

We claim:

1. A lavatory, comprising:

a housing having a frame opening;

a bowl with a seat supported in the frame opening for swivelling movement between a use position and a flushing position in which the bowl and the seat are cleaned;

a feces drain located in the housing and connectable with the bowl;

a water reservoir located in the housing; and a cleaning apparatus for cleaning the bowl and the seat and supported in the housing for pivotal movement between a rest position and an operating position in which the bowl and the seat are cleaned, the cleaning apparatus including a plurality of spray nozzles rotatable about an axis for cleaning the bowl and the seat with water emerging under pressure from the spray nozzles, and a cover for covering the spray nozzles;

wherein the cleaning apparatus is pivoted into the operating position thereof simultaneously with swivelling of the bowl, together with the seat, into the flushing position thereof, and wherein the cover moves onto the bowl, upon the pivotal movement of the cleaning apparatus into the operating position thereof and the swivelling movement of the bowl into the flushing position thereof, and forms, together with the bowl, a cleaning space which is fluid-tight sealed from the rest of the housing interior.

2. A lavatory as claimed in claim 1, wherein the cleaning apparatus further comprises the water reservoir, pumping means arranged on the cover for supplying pressurized water to the spray nozzles, and a flushing water supply pipe for connecting the pumping means with the water reservoir.

3. A lavatory as claimed in claim 2, wherein the cleaning apparatus has at least one rotating arm for supporting spray nozzles which, in the flushing position of the bowl, are directed toward the seat.

4. A lavatory as claimed in claim 1, further comprising single drive means for effecting both swivelling of the bowl and pivoting of the cleaning apparatus.

5. A lavatory as claimed in claim 1, comprising means for supporting the bowl for rotation about a horizontal axis, and wherein the bowl assumes a swivelled-up position, in the flushing position thereof, in which a feces outlet of the bowl faces the feces drain.

* * * * *

UNITED STATES PATENT AND TRADEMARK OFFICE

CERTIFICATE OF CORRECTION

PATENT NO : 5,960,483
DATED : October 5, 1999
INVENTOR(S) : Siegfried Delzer et al.

It is certified that error appears in the above-identified patent and that said Letters Patent is hereby corrected as shown below:

Title page, to item [73]: Herrenschmidt Stefan, Reinach Switzerland
Delete: Keramilk Laufen AG. Laufen. Switzerland Signed and Sealed this Tenth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,960,483
DATED : October 5, 1999
INVENTOR(S) : Siegfried Delzer, et al.

It is certified that error appears in the above-identified patent and that said Letters Patent is hereby corrected as shown below:

On the Title Page Item [73] should read:
{73} Assignee: Stefan Herrenschmidt, Reinach, Switzerland

Signed and Sealed this

Twenty-fourth Day of July, 2001

*Attest:*

Nicholas P. Godici

NICHOLAS P. GODICI
*Acting Director of the United States Patent and Trademark Office*

*Attesting Officer*